United States Patent [19]

Ciccotelli

[11] Patent Number: 4,773,885

[45] Date of Patent: Sep. 27, 1988

[54] SWIM FIN WITH BLADE DISPLACED FROM FOOT POCKET

[76] Inventor: Stephen S. Ciccotelli, P.O. Box 1414, Deming, N. Mex. 88031

[21] Appl. No.: 40,259

[22] Filed: Apr. 20, 1987

Related U.S. Application Data

[63] Continuation-in-part of Ser. No. 842,282, Mar. 21, 1986, Pat. No. 4,689,029.

[51] Int. Cl.[4] ..... A63B 31/08

[52] U.S. Cl. ..... 441/64

[58] Field of Search ..... 441/61–64

[56] References Cited

U.S. PATENT DOCUMENTS 3,302,223 2/1967 Ciccotelli ..... 441/64

FOREIGN PATENT DOCUMENTS 1245395 9/1960 France ..... 441/64
1373065 8/1964 France ..... 441/64
2410488 8/1979 France ..... 441/64

*Primary Examiner*—Sherman D. Basinger
*Assistant Examiner*—Jesù D. Sotelo
*Attorney, Agent, or Firm*—Cahill, Sutton & Thomas

[57] ABSTRACT

In the first form of the present invention, a swim fin includes a foot pocket, two flexible beams projecting forwardly therefrom, a blade attached to the forward end portions of the flexible beams and displaced from the foot pocket, the foot pocket, flexible beams and blade all being molded in one piece. A narrow rigid plate is attached to the blade and flexible beams at a point near the leading edge of the blade to connect the flexible beams to support the leading edge of the blade, and together with the part of the flexible beams attached to the blade, to provide a blade structure which is generally rigid during swimming but is flexible during walking and standing. In the second form of the present invention, the foot pocket and flexible beams are molded in one piece whereas the blade which is rigid is molded separately. The forward end portions of the flexible beams are attached to the rigid blade with fasteners.

3 Claims, 2 Drawing Sheets

14
2
8
4
2A
3
4A
6
7
1
5
4

SWIM FIN WITH BLADE DISPLACED FROM FOOT POCKET

CROSS-REFERENCE TO RELATED APPLICATION

This application is a continuation-in-part of my pending application entitled "IMPROVED SWIM FIN", Ser. No. 842,282, filed Mar. 21, 1986, now U.S. Pat. No. 4,689,029 issued Aug. 25, 1987 incorporated herein by reference.

BACKGROUND OF THE INVENTION

This invention relates to swim fins of the type having a rigid blade with a leading edge and a trailing edge supported from a foot pocket so that a space exists between the foot pocket and the blade.

In the above-referenced patent application Ser. No. 842,282, a swim fin is illustrated using a rigid narrow streamlined blade with an 18 inch blade span, the blade and flexible beams being attached to a wire form. A swim fin with this type of blade is very efficient for swimming but is not suitable for making an entry into heavy surf because the wire form used to support the blade reduces flexibility during walking and standing, making it difficult to maintain his balance while putting the fins on under these conditions. It is important that a swim fin of the type described in above-referenced patent application Ser. No. 842,282 must not be so stiff that it makes walking by the wearer unduly difficult. A serious swimmer or diver using such a swim fin frequently needs to walk a significant distance, often carrying quite a lot of equipment, including scuba tanks, spear guns, etc. Obviously, the swimmer or diver must safely maintain his balance while walking along a beach surface into the water, sometimes through heavy surf. I have found that it is important that the wearer of the swim fin be able to walk in a somewhat normal manner, carrying the above equipment, while wearing the swim fins. None of the prior swim fins having a wire form or metal frame attached to a blade that is displaced from the foot pocket allow walking without undue difficulty.

SUMMARY OF THE INVENTION

It is an object of the invention to provide a swim fin that is flexible during walking and standing but has a blade that is generally rigid during swimming to achieve good efficiency.

It is a further object of this invention to provide a swim fin with the above-mentioned features which requires no wire form or metal frame, and in which the blade is displaced from the toe of the foot pocket to achieve improved efficiency.

In its broadest aspect, the first form of the present invention includes a foot pocket, two flexible beams projecting from the sides of the foot pocket, and a flexible blade having a rigid section located near its leading edge. The flexible blade is attached to the end portions of the flexible beams and the blade is displaced from the toe of the foot pocket.

In the second form, the blade is formed of thermoplastic and is rigid. In both first and second forms of the present invention a rigid surface is utilized to which the end portions of the flexible beams are clamped with fasteners at a point near the leading edge of the blade to prevent the flexible beams from twisting when severely stressed. Also the attachment of the end portions of the flexible beams to the blade is made in the area between the lateral sides of the blade. Both forms use a stabilizer surface on the upper surface of the blade to perform the function of stabilizing the blade during swimming.

Other features and advantages not specifically enumerated above will be apparent after consideration of the following detailed description and appended claims.

The presently preferred form which the invention may assume is illustrated in the accompanying drawings.

DETAILED DESCRIPTION OF THE INVENTION

Figures 1, 2, 3, 4:
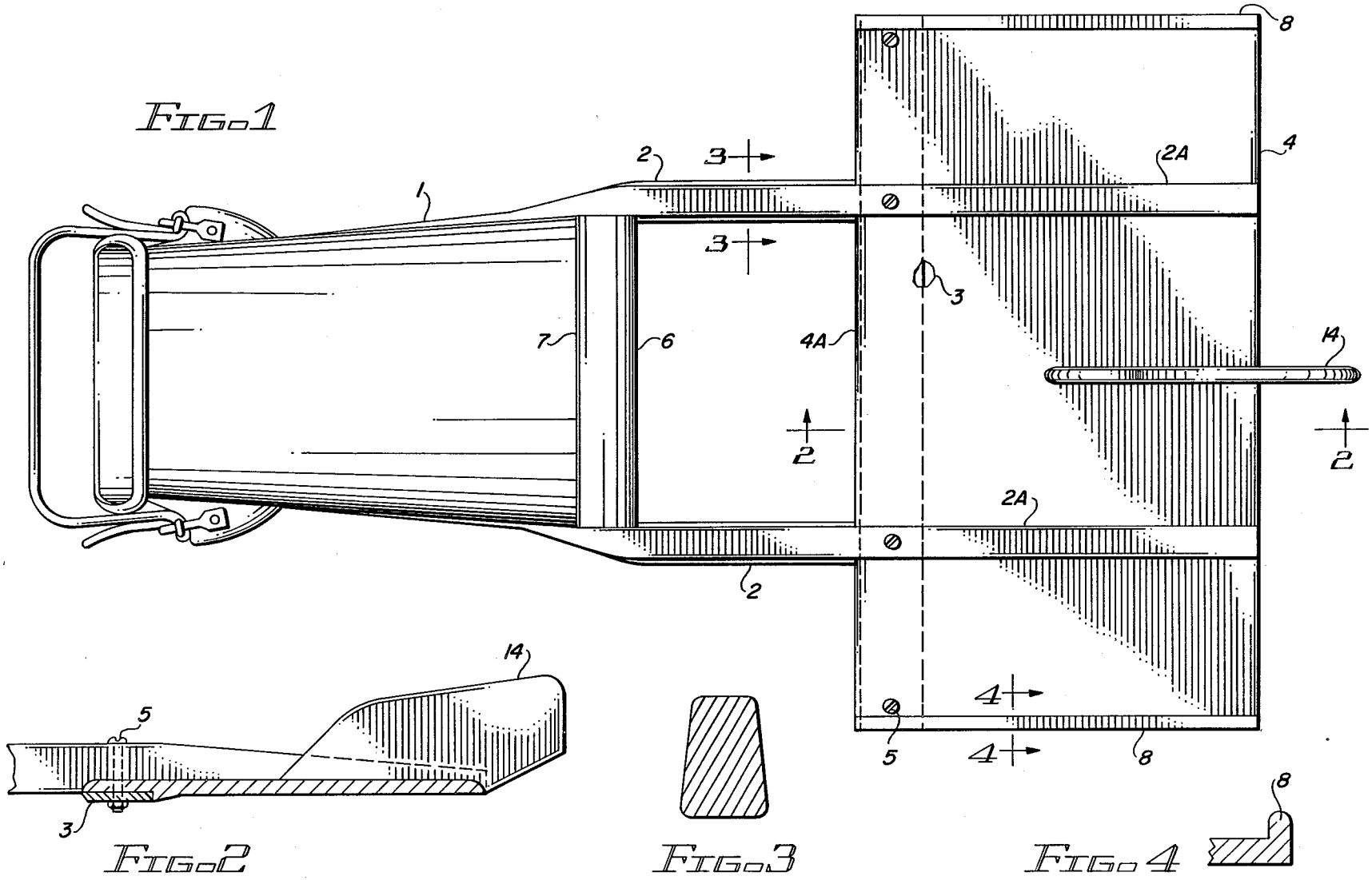
FIG. 1 is a plan view of the first form of the swim fin of the present invention.
FIG. 2 is a partial sectional view taken along section line 2—2 of FIG. 1.
FIG. 3 is an enlarged section view taken along section line 3—3 of FIG. 1.
FIG. 4 is a partial sectional view taken along section line 4—4.

Referring to FIGS. 1 through 4 of the drawings, in the first form of the present invention the swim fin includes a foot pocket 1 with two flexible beams 2, each having an end portion 2A, projecting forwardly from the foot pocket. A blade 4 has a leading edge 4A, a rib 8 on each lateral side, illustrated in FIG. 4, and is spaced from the toe 6 of the foot pocket. The foot pocket 1, flexible beams 2, and the blade 4 all are molded in one integral piece. A rigid metal plate 3 about one inch wide is attached to the the end portions 2A of the flexible beams and the blade near its leading edge 4A with fasteners 5. Preferably the integral piece consisting of foot pocket 1, flexible beams 2 and flexible blade 4 is composed of suitable or rubber-like thermoplastic elastomer material of the type of which swim fins are commonly manufactured. Exemplary dimensions for the flexible blade 4 are approximately 11.5 inches by 6.5 inches.

Blade 4 is displaced from foot pocket 1, by 3.5 inches in the present swim fin. As molded, the structure is too weak for use as a swim fin. In accordance with the present invention, the rigid plate 3 is attached to the end portions of the flexible beams and blade near the leading edge 4A of the blade 4, greatly strengthening the molded structure.

Buckling of the flexible beams can occur during walking when the blade tip sticks in the sand or mud and the diver continues to move his foot forward. Even though no damage is thereby done to the flexible beams, this is undesirable in swim fins designed for scuba divers.

To strengthen the flexible beams, the following design features are incorporated. (1) The toe 6 of foot pocket 1, illustrated in FIG. 1, is given a square configuration (as shown in FIG. 1) instead of a rounded configuration as in the conventional swim fin. (2) A coating 7, illustrated in FIG. 1 of the same grade of plastic of which the flexible beams are composed is molded over the toe portion of the foot pocket. This is common practice in conventional swim fin design to strengthen the blade in a vented area.

The above design features (1) and (2) cooperate to form a rigid box-like structure which prevents the flexible beams from twisting at the toe area of the foot pocket. (3) The flexible beams are designed to project directly forwardly from the foot pocket to provide short strong flexible beams.

It should be understood that flexible beams that flare out from the sides of the foot pocket are relatively weak because the stresses in such flexible beams are combined torsional and bending. This causes the flexible beams to buckle more easily when severely stressed. (4) When the forward blade tip sticks in the sand or mud during walking, and the diver continues to move his foot forward, the bottoms of the flexible beams are in compression, and if buckling occurs, it begins at the bottoms of the flexible beams. To reinforce the bottom of the flexible beams, they are formed with sloping sides to provide the flexible beams with a greater cross sectional area at their bottom portions, as illustrated in FIG. 3.

The beams 2 are sufficiently flexible to bend enough so that the wearer, with his foot in foot pocket 1 can walk along a beach in a normal fashion, with his heel raising as his foot rolls forward on its ball. Nevertheless, beams 2 are sufficiently stiff that during swimming, the flexible beams 2 flex only enough to provide good finning action of blade 4, in accordance with the principles described in the above-referenced application Ser. No. 842,282.

In the first form of the invention, by attaching the rigid plate 3 to the blade and the flexible beams 2 at a point near the leading edge of blade 4, the flexible beams 2 are connected by the foot pocket 1 and the rigid plate 3, thus forming a rectangular rigid four-sided frame, which gives the swim fin much of its strength. The rigid plate also performs the function of supporting the leading edge of blade 4. Thus, in accordance with the first form of the present invention, the rigid plate 3, the end portions 2A of the flexible beams 2, the ribs 8, and the foot pocket 1 cooperate to provide both rigidity for blade 4 during swimming and flexibility of the swim fin as the wearer stands and walks.

The stability during swimming of a blade having the size and configuration illustrated is poor, so a stabilizer surface 14, illustrated in FIGS. 1 and 2, is utilized to increase stability. The stabilizer surface 14 is located on the center line of blade 4, and projects upward from the upper surface of blade 4. For maximum effectiveness, the stabilizer surface 14 extends forward beyond the tip of blade 4, a shown in FIG. 2.

Figure 5:
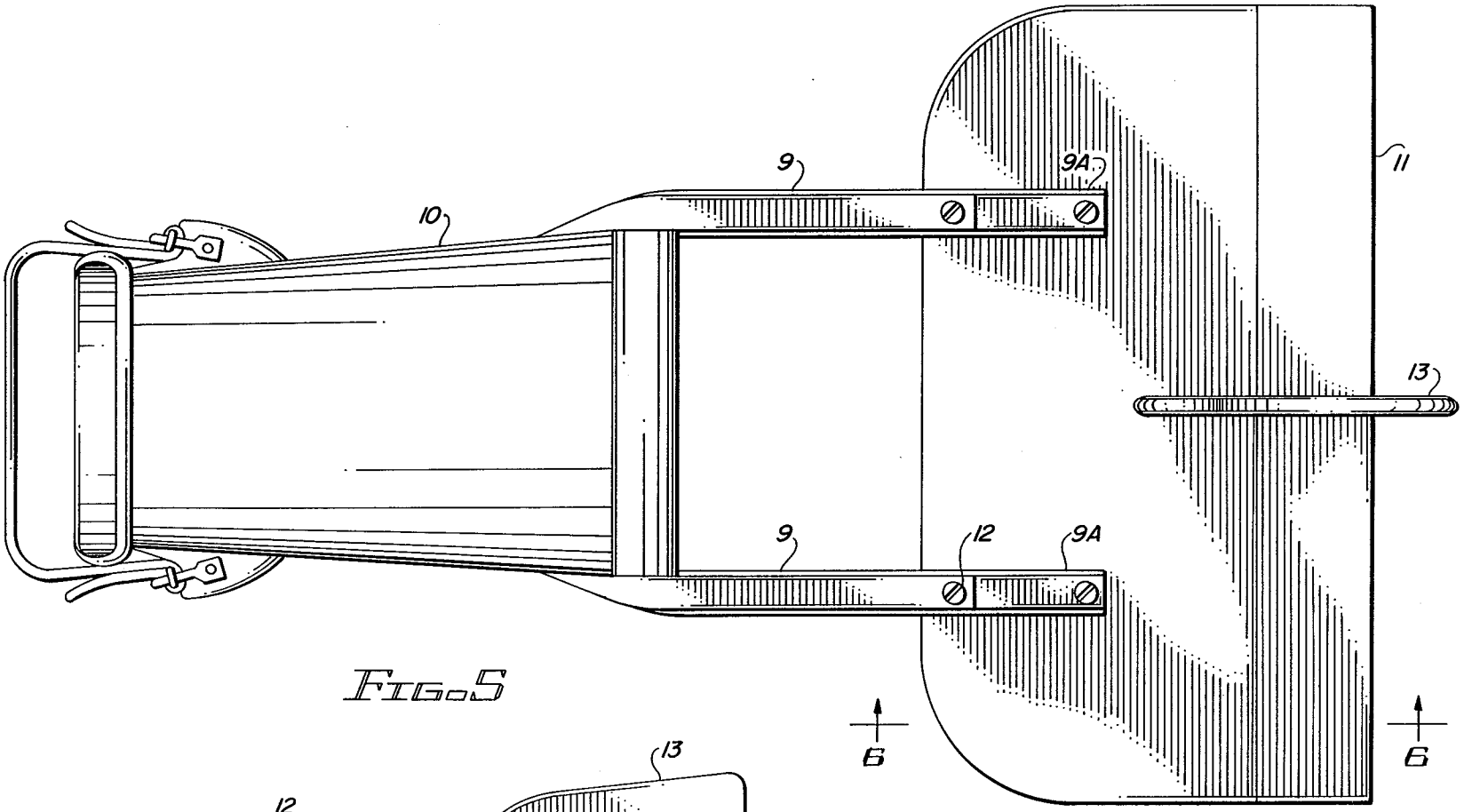
FIG. 5 is a plan view of the second form of the invention.
Figure 6:
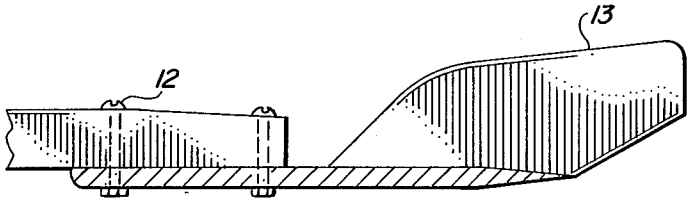
FIG. 6 is a partial sectional view taken along section line 6—6.

Referring to FIGS. 5 and 6, in the second form of the present invention, the flexible beams 9 and the foot pocket 10 are molded in one piece of thermoplastic elastomer and the forward end portions 9A of the flexible beams 9 are attached to a rigid blade 11, which is molded separately of thermoplastic, with fasteners 12.

In both first and second forms of the present invention, a rigid surface is required to make an attachment to the end portions of the flexible beams at a point near the leading edge (i.e., the left vertical edge as illustrated in FIGS. 1 and 5) of the blade to prevent the flexible beams from twisting. Also, the attachment of the remaining part of the end portions of the flexible beams to the blade, in both forms, is made in the area between the lateral sides of the blade. A stabilizer surface is required for both forms.

Thus, the invention described herein provides the benefits of a highly efficient swim fin when it is being worn by a swimmer or diver both during swimming and when the swimmer or diver walks along the beach while wearing the fin. The relatively easy flexing of the flexible beams allow convenient, safe, entry of the swimmer or diver into the water, while carrying various scuba diving accessories and the like. Furthermore, the flexing of flexible beams 2 makes it easier for the diver to put on or remove the swim fins.

While the invention has been described with respect to a number of embodiments, those skilled in the art will be able to make various modifications to the described embodiment without departing from the true spirit and scope of the invention. It is intended that all structures and techniques which are equivalent to those described herein in that they perform substantially the same function in substantially the same way to achieve the same result are within the scope of the invention.

I claim:

1. In a swim fin, the combination comprising:

(a) a foot pocket having first and second sides and a toe end;

(b) a rigid blade molded separately and displaced from the toe end of the foot pocket and having a leading edge and a trailing edge and first and second lateral sides;

(c) first and second flexible beams extending forwardly from the toe end of the foot pocket, each having a rear end portion attached to the first and second sides of the foot pocket respectively and each having a forward end portion; and (d) means, including fasteners for attaching the rigid blade to the forward end portions of the first and second flexible beams, each forward end portion of the flexible beams being attached to the rigid blade at a position near the leading edge of the rigid blade, all attachments of the blade to the first and second flexible beams being made in the area of the blade between the first and second lateral sides.

2. In the swim fin recited in claim 1, the combination wherein the forward end portion of the first flexible beam includes a first hole located near the end of the first flexible beam and a second hole located at a position near the leading edge of the rigid blade, the forward end portion of the second flexible beam includes a third hole located at a position near the end of the second flexible beam and a fourth hole located at a position near the leading edge of the rigid blade, fifth, sixth, seventh, and eighth holes in the rigid blade aligned with the first, second, third and fourth holes, respectively, the fasteners including a first screw extending through the first and fifth holes, a first nut on an end of the first screw, a second screw extending through the second and sixth holes, and a second nut on an end of the second screw, a third screw extending through the third and seventh holes, and a third nut on an end of the third screw, a fourth screw extending through the fourth and eighth holes, and a fourth nut on an end of the fourth screw.

3. In the swim fin recited in claim 1, the combination including a stabilizer having a leading end and a trailing end located on a center line of the rigid blade, a leading end of the stabilizer being positioned between the leading and trailing edges of the rigid blade, the trailing end of the stabilizer extending beyond the trailing edge of the rigid blade.

* * * * *